United States Patent [19]

Hempfling

[11] 4,173,086

[45] Nov. 6, 1979

[54] SIGN STRUCTURE

[76] Inventor: Walter L. Hempfling, 3028 Colerain Ave., Cincinnati, Ohio 45225

[21] Appl. No.: 752,798

[22] Filed: Dec. 20, 1976

[51] Int. Cl.[2] ..... G09F 15/00

[52] U.S. Cl. ..... 40/607; 40/10 C

[58] Field of Search ..... 40/10 C, 145 R, 128, 40/125 H, 125 R, 607

[56] References Cited

U.S. PATENT DOCUMENTS

| | | | |
|---|---|---|---|
| 1,116,942 | 11/1914 | Smith | 40/128 |
| 2,914,874 | 12/1959 | Stein | 40/125 H |
| 4,009,532 | 3/1977 | Thomas | 40/128 |

FOREIGN PATENT DOCUMENTS

| | | | |
|---|---|---|---|
| 3749 | of 1901 | United Kingdom | 40/10 C |
| 12743 | of 1906 | United Kingdom | 40/10 C |

*Primary Examiner*—Louis G. Mancene
*Assistant Examiner*—Wenceslao J. Contreras
*Attorney, Agent, or Firm*—James W. Pearce; Roy F. Schaeperklaus

[57] ABSTRACT

A sign structure which includes a pole member, means for mounting the pole member in upright position, and a sign panel member mounted on the upper portion of the pole member. The sign panel member includes a main panel portion, a bend portion, and a minor panel portion separated from the main panel portion by the bend portion. The upper portion of the pole member is cross shaped. An opening in the bend portion receives an upper end portion of the pole member with the inner side of the bend portion supported by side arms thereof.

10 Claims, 4 Drawing Figures

FIG. 1
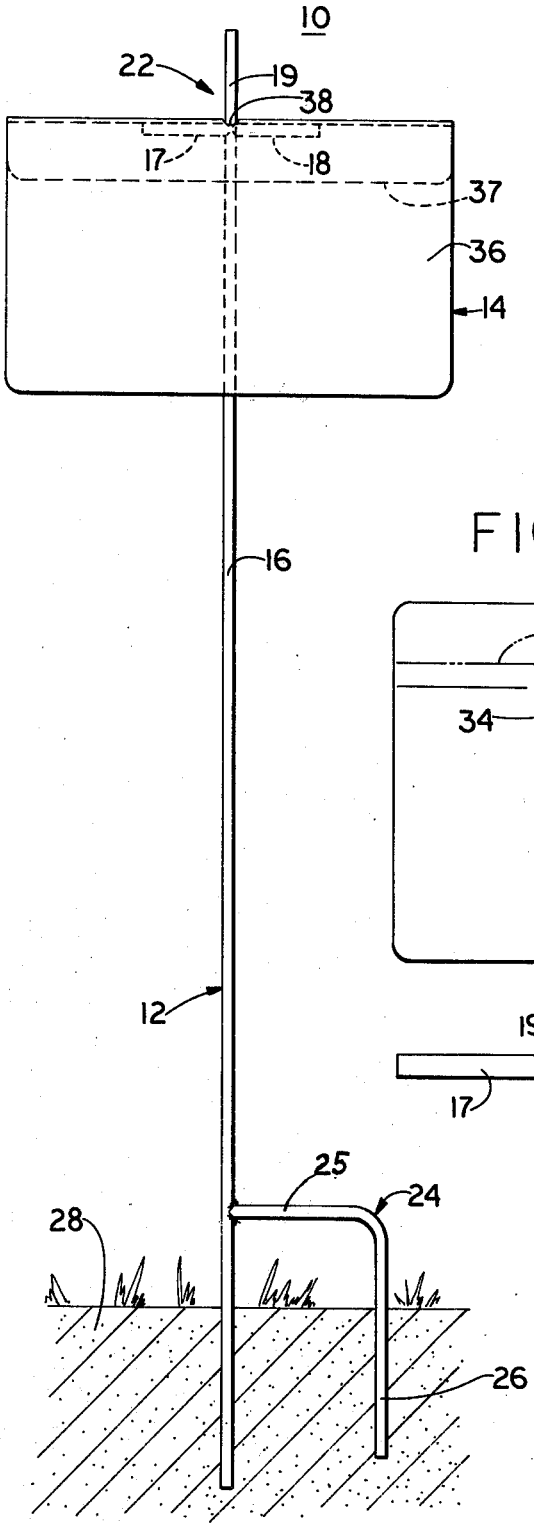
FIG. 2
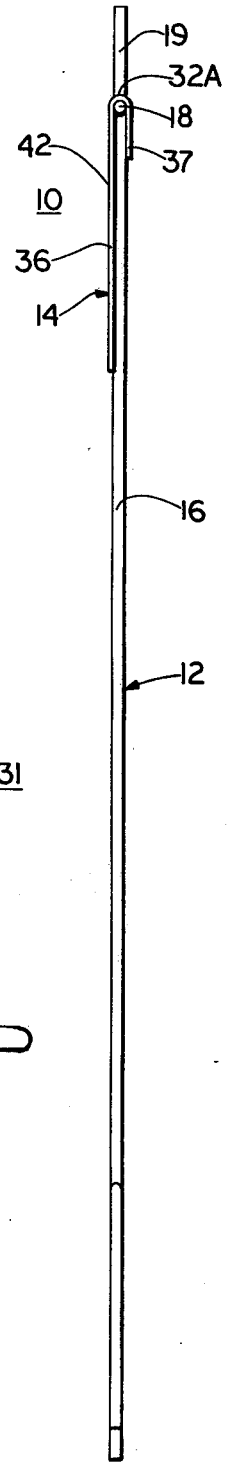
FIG. 4
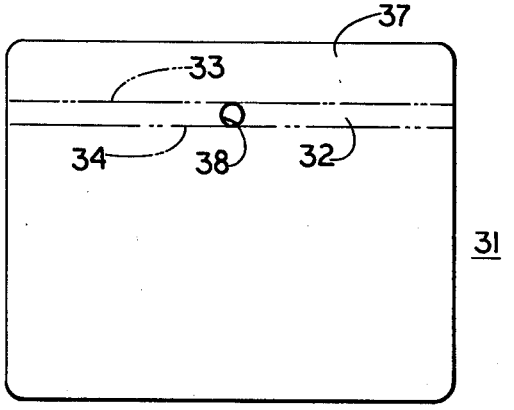
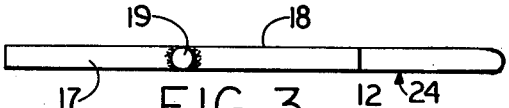
FIG. 3

SIGN STRUCTURE

This invention relates to a sign structure. More particularly, this invention relates to a pole-type sign structure having a readily changeable sign panel.

An object of this invention is to provide such a sign structure having a removable sign panel which is held in place by gravity and which is releasably held in a stationary position on a pole member.

A further object of this invention is to provide such a sign structure in which the sign panel is hung on cross arms of the pole member.

Briefly, this invention provides a pole-type sign structure which includes an upright pole member having an upper section of cross shape. A sign panel is mounted on the pole member. The sign panel includes a main panel portion, a return bend portion which overlies cross arms of the pole member, and a minor panel portion which is substantially parallel to the main panel portion. An opening in the return bend portion receives an upright arm of the upper portion of the pole member. The main panel portion and the minor panel portion are engageable with a portion of the pole member underlying the cross arms to hold the sign panel against swinging.

The above and other objects and features of the invention will be apparent to those skilled in the art to which this invention pertains from the following detailed description and the drawing, in which:

FIG. 1 is a view in front elevation of a sign structure constructed in accordance with an embodiment of this invention, a lower end portion of a pole member of the sign structure being shown mounted in the ground, the ground being shown in section;

FIG. 2 is a view in side elevation of the sign structure;

FIG. 3 is a top plan view on an enlarged scale of the pole member of the sign structure; and FIG. 4 is a plan view of a sign panel of the sign structure in unfolded position, the portion to be formed in a return bend being indicated in double-dot-dash lines.

In the following detailed description and the drawing, like reference characters indicate like parts.

In FIGS. 1 and 2 is shown a sign structure 10 constructed in accordance with an embodiment of this invention. The sign structure includes a pole member 12 and a sign panel member 14.

The pole member 12 includes a main upright pole or bar member 16 and side arms 17 and 18 attached to the upright bar member 16 near but spaced from an upper end thereof so that a short upper arm portion 19 of the bar member 16 projects upwardly above the side arms 17 and 18 and an upper end portion 22 of the pole member 12 is of cross shape. The side arms 17 and 18 are mounted in aligned coaxial relation with the common axis of the side arms 17 and 18 intersecting the axis of the bar member 16. An angle shaped brace 24 has an arm portion 25 attached to the upright bar member 16 near the lower end thereof and extending outwardly therefrom to an integral depending upright leg 26 of the brace 24 parallel to the upright bar member 16 so that the lower end portion of the upright bar member 16 and the upright leg 26 of the brace 24 can be inserted in ground 28 to support the upright bar member 16 in vertical position. A foot may be placed on arm portion 25 to facilitate insertion of the lower end portion of pole 12 and leg 26 into ground 28. The side arms 17 and 18 and the arm portion 25 of brace 24 can be mounted on the upright bar member 16 as by welding.

The sign panel member 14 can be formed from a sheet metal blank 31 (FIG. 4). A transverse bend area 32, defined by double-dot-dash lines 33 and 34, separates a main panel portion 36 from a minor panel portion 37. A central opening 38 is formed in the bend area 32 and may be of a dimension perpendicular to lines 33,35 equal to 1.5 times the dimension of the pole perpendicular to the axis of side arms 17, 18. The bend area 32 is formed or bent to an arc of the shape shown at 32A in FIG. 2 to bring the main panel portion 36 and the minor panel portion 37 into parallelism with the spacing between the panel portions 36 and 37 being substantially equal to the diameter of the portion of the upright bar portion 16 immediately below the side arms 17 and 18. The dimension of the central opening 38 is substantially equal to the distance between the panels 36,37 and to the diameter of the upper arm portion 19 of the bar member 16 so that, when the sign panel member 12 is mounted on the pole member 14, as shown in FIG. 2, with the inner face of the bend area 32A resting on the side arms 17 and 18, the edge of the opening 38 grips the upper arm portion 19, and inner faces of the main panel portion 36 and the minor panel portion 37 substantially engage the upright bar 16 so that the sign panel member 14 is removably but firmly held in position on the pole member. Interaction between the panel portions 36 and 37, the upright bar 16 and the side arms 17 and 18 prevents twisting or turning of the sign panel member on the pole member 12. The inner face of the bend area 32A can be in substantially conforming contact with the opposed outer upward facing surface of the side arms 17 and 18.

Appropriate indicia, not shown, can be provided on an exposed face 42 of the main panel portion 36.

The sign structure illustrated in the drawing and described above is subject to structural modification without departing from the spirit and scope of the appended claims.

Having described my invention, what I claim as new and desire to secure by Letters Patent is:

1. A sign structure which includes a pole member, means for mounting the pole member in upright position, oppositely extending aligned side arms mounted on the pole member adjacent but spaced below an upper end thereof, and a sign panel member mounted on the upper portion of the pole member in gripping relation thereto, the sign panel member including a first panel portion, a bend portion and a second panel portion separated from the first panel portion by the bend portion, there being an opening in the bend portion receiving an upper end portion of the pole member with the inner side of the bend portion supported by the side arms and the first and second panel portions respectively embracingly contacting the pole member therebetween.

2. A sign structure in accordance with claim 1 wherein the first panel portion and the second panel portion are parallel and spaced a distance substantially equal to the diameter of the pole member in engagement with opposite sides of the portion of the pole member below the side arms while the sign panel member is mounted on the pole.

3. A sign structure as in claim 1 wherein the side arms are in alignment and the axis of the side arms intersects the axis of the pole member.

4. A sign structure in accordance with claim 1 wherein an angle brace is mounted on the pole member with a leg portion spaced from and parallel to the pole member and extending in like direction as the pole member to a respective free end.

5. A sign structure as in claim 1 wherein at least one portion of the bend portion bounding the opening grippingly engages the pole member in said opening.

6. A sign structure as in claim 8 wherein at least one portion of the bend portion bounding the opening grippingly engages the pole member in said opening.

7. A sign structure which includes a pole member, means for mounting the pole member in upright position, oppositely extending aligned side arms mounted on the pole member adjacent but spaced below an upper end thereof, and a sign panel member mounted on the upper portion of the pole member in gripping relating thereto, the sign panel member including a first panel portion, a bend portion and a second panel portion separated from the first panel portion by the bend portion, there being an opening in the bend portion receiving an upper end portion of the pole member with the inner side of the bend portion supported by the side arms and the first and second panel portions respectively embracingly contacting the pole member therebetween, an angle brace mounted on the pole member with an arm portion extending parallel to the side arms mounted on the pole and a leg portion spaced from and parallel to the pole member and extending in like direction as the pole member to a respective free end.

8. A sign structure which includes a pole member, means for mounting the pole member in upright position, side arm means mounted on the pole member adjacent but spaced below an upper end thereof, and a sign panel member mounted on the upper portion of the pole member, the sign panel member including a first panel portion and a bend portion along an edge of the first panel portion, there being an opening in the bend portion receiving an upper end portion of the pole member with the inner side of the bend portion supported by the side arm means and the first panel portion contacting a portion of the pole member spaced from the portion thereof received in the opening in the bend portion.

9. A sign structure in accordance with claim 8 wherein an angle brace is mounted on the pole member with a leg portion spaced from and parallel to the pole member and extending in like direction as the pole member to a respective free end.

10. A sign structure which includes a pole member, means for mounting the pole member in upright position, side arm means mounted on the pole member adjacent but spaced below an upper end thereof, and a sign panel member mounted on the upper portion of the pole member, the sign panel member including a first panel portion and a bend portion along an edge of the first panel portion, there being an opening in the bend portion receiving an upper end portion of the pole member with the inner side of the bend portion supported by the side arm means and the first panel portion contacting a portion of the pole member spaced from the portion thereof received in the opening in the bend portion, an angle brace mounted on the pole member with an arm portion extending parallel to the side arms mounted on the pole and a leg portion spaced from and parallel to the pole member and extending in like direction as the pole member to a respective free end.

* * * * *